US008449069B2

(12) United States Patent
Ogawa

(10) Patent No.: US 8,449,069 B2
(45) Date of Patent: May 28, 2013

(54) LIQUID-JETTING APPARATUS

(75) Inventor: Mikio Ogawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 253 days.

(21) Appl. No.: 13/053,574

(22) Filed: Mar. 22, 2011

(65) Prior Publication Data

US 2011/0242205 A1 Oct. 6, 2011

(30) Foreign Application Priority Data

Mar. 30, 2010 (JP) ..... 2010-077362

(51) Int. Cl.
*B41J 2/165* (2006.01)

(52) U.S. Cl.
USPC ..... 347/29

(58) Field of Classification Search
USPC ..... 347/22, 23, 29
See application file for complete search history.

(56) References Cited

U.S. PATENT DOCUMENTS

| | | | | |
|---|---|---|---|---|
| 6,857,720 | B2 * | 2/2005 | Koller et al. | 347/22 |
| 7,357,475 | B2 * | 4/2008 | Silverbrook | 347/25 |
| 7,401,888 | B2 * | 7/2008 | Karppinen et al. | 347/25 |
| 2005/0212873 | A1 | 9/2005 | Usui et al. | |
| 2006/0001715 | A1 | 1/2006 | Umeda et al. | |
| 2007/0296754 | A1 | 12/2007 | Hiraki et al. | |
| 2008/0174645 | A1 | 7/2008 | Umeda et al. | |

FOREIGN PATENT DOCUMENTS

| | | | |
|---|---|---|---|
| JP | 2004-255861 | A | 9/2004 |
| JP | 2007-331268 | A | 12/2007 |
| JP | 2008-183855 | A | 8/2008 |

OTHER PUBLICATIONS

Japan Patent Office, Decision to Grant a Patent for Japanese Patent Application No. 2010-077362 (counterpart Japanese patent application), mailed Aug. 15, 2012.

* cited by examiner

*Primary Examiner* — Lamson Nguyen
(74) *Attorney, Agent, or Firm* — Baker Botts L.L.P.

(57) ABSTRACT

A liquid-jetting apparatus includes: a liquid-jetting head which has a liquid-jetting surface provided with first and second nozzles and which jets liquids of different types from the first and second nozzles respectively; a cap which is driven between a capping position and a retracted position; a cap driving member which moves in a first direction to drive the cap; first and second gas discharge valves via which bubble is discharged from first and second liquid supply members connected to the liquid-jetting head respectively; first and second valve opening/closing members which open/close the first and second gas discharge valves respectively; first and second gas discharge driving members arranged in the first direction, which move in a second direction intersecting the first direction to drive the first and second valve opening/closing members respectively; and a driving source which moves the first and second gas discharge driving members in the second direction.

7 Claims, 11 Drawing Sheets

LIQUID-JETTING APPARATUS

CROSS REFERENCE TO RELATED APPLICATION

The present application claims priority from Japanese Patent Application No. 2010-077362, filed on Mar. 30, 2010, the disclosure of which is incorporated herein by reference in its entirety.

BACKGROUND OF THE INVENTION

1. Field of the Invention

The present invention relates to a liquid-jetting apparatus which jets liquids.

2. Description of the Related Art

A color ink-jet printer has been hitherto known as a liquid-jetting apparatus for jetting liquids of mutually different types from two types of nozzles, which is provided with an ink-jet head for jetting a color ink or color inks and a black ink with respect to the recording paper or the like. Such an ink-jet printer is sometimes provided with a nozzle cap (suction cap) which is capable of being brought in tight contact with a liquid-jetting surface of an ink-jet head, as a structure for protecting nozzles and/or performing the suction purge to forcibly suck and discharge any viscosity-increased ink and any bubble from the nozzles, as in an ink-jet printer described in US 2007/0296754 (corresponding to Japanese Patent Application Laid-open No. 2007-331268). In addition thereto, such an ink-jet printer is sometimes provided with a structure to perform the gas discharge purge in which the bubble is sucked and discharged from the ink flow passage disposed upstream from the nozzles. Specifically, such an ink-jet printer is sometimes provided with a bubble storage chamber to which the ink is supplied from a cartridge and which is communicated with an ink-jet head, a gas discharge valve which is provided to discharge the bubble from the bubble storage chamber, and a gas discharge cap which is capable of being brought in tight contact with an opening surface of a discharge port to be opened/closed by a gas discharge valve of the bubble storage chamber. The bubble storage chamber and the gas discharge valve are provided for each of the types of the inks. Further, the suction cap and the gas discharge cap are connected to a suction pump via a switching means (changeover means) which is capable of switching the communication between the suction cap and the suction pump and the communication between the gas discharge cap and the suction pump.

In the ink-jet printer as described above, the suction purge is performed by operating the suction pump after performing the switching or changeover so that the suction cap and the suction pump are communicated with each other in a state in which the suction cap is brought in tight contact with the liquid-jetting surface. In this way, the ink, which contains the viscosity-increased ink and/or the bubble, is sucked and discharged from the nozzles into the suction cap. On the other hand, the gas discharge purge is performed by operating the suction pump connected to the suction cap after performing the switching or changeover so that the gas discharge cap and the suction pump are communicated with each other in a state in which the gas discharge valve is opened and the bubble storage chamber is opened in a situation in which the gas discharge cap is brought in tight contact with the opening surface. Accordingly, the bubble can be discharged to the gas discharge cap from the bubble storage chamber which is positioned on the upstream side from the nozzles without allowing the air to be mixed from the nozzles.

The gas discharge valve is opened/closed by an opening/closing member. The opening/closing member is constructed to make contact with a slider, and the gas discharge valve is opened/closed by being moved in the upward-downward direction in accordance with the movement of the slider in one direction. Further, the slider is engaged with a cam groove of a rotary cam, and the slider is moved in one direction parallel to a rotary surface of the rotary cam in accordance with the rotation of the rotary cam. The opening/closing member and the slider are provided distinctly as those for the color inks and those for the black ink respectively. The slider (first gas discharge driving member) for opening/closing the gas discharge valve for the color ink and the slider (second gas discharge driving member) for opening/closing the gas discharge valve for the black ink are engaged with the cam groove of the same rotary cam. That is, when the rotary cam is rotated, the slider is moved in one direction parallel to the rotary surface. In this way, the opening/closing member is moved in the upward-downward direction in accordance with the movement of the slider, and the gas discharge valve is driven and opened/closed.

In the ink-jet printer described in US 2007/0296754, it is noted that the slider for the color ink and the slider for the black ink are engaged with the cam groove of the same rotary cam. Therefore, the two sliders are successively driven by the cam groove in accordance with the rotation of the rotary cam, and the gas discharge valve for the color ink and the gas discharge valve for the black ink are successively opened/closed. In this case, for example, when only the gas discharge purge for the color ink is performed, if the gas discharge valve for the color ink is opened, then the gas discharge valve for the black ink is also opened in some cases in accordance with the rotation of the rotary cam. However, the gas discharge purge is not performed for the black ink. Therefore, when the gas discharge valve for the black ink is opened, the air comes from the discharge port of the bubble storage chamber.

In order that the gas discharge valve for the color ink and the gas discharge valve for the black ink can be selectively opened/closed, the slider for the color ink and the slider for the black ink may be moved by being driven distinctly by means of driving sources such as distinct motors or the like respectively. However, in this case, the cost is increased and the apparatus is large-sized as compared with the case in which one driving source is used.

SUMMARY OF THE INVENTION

In view of the above, an object of the present invention is to provide a liquid-jetting apparatus wherein the cost is reduced and the apparatus is small-sized or miniaturized by moving both of a first gas discharge driving member and a second gas discharge driving member by means of one driving source, and a first gas discharge valve and a second gas discharge valve can be selectively opened/closed while positioning a cap at a capping position by regulating the movement of any one of the first gas discharge driving member and the second gas discharge driving member.

According to an aspect of the present invention, there is provided a liquid-jetting apparatus including a liquid-jetting head which has a liquid-jetting surface provided with first nozzles and second nozzles opening thereon and which jets liquids of mutually different types from the first and second nozzles respectively; a cap which is driven between a capping position at which the cap is brought in tight contact with the liquid-jetting surface of the liquid-jetting head and a retracted position at which the cap is separated from the liquid-jetting surface; a cap driving member which moves in a predetermined first direction to drive the cap; a first gas discharge valve and a second gas discharge valve which are constructed so that any bubble is discharged from a first liquid supply member connected to the liquid-jetting head for supplying the liquid to the first nozzles and a second liquid supply member connected to the liquid-jetting head for supplying the liquid to the second nozzles respectively; a first valve opening/closing member which opens/closes the first gas discharge valve and a second valve opening/closing member which opens/closes the second gas discharge valve; a first gas discharge driving member and a second gas discharge driving member which are arranged while being aligned in the first direction, which move in a second direction intersecting the first direction along an arrangement surface thereof to drive the first valve opening/closing member and the second valve opening/closing member respectively; and a driving source which moves both of the first gas discharge driving member and the second gas discharge driving member in the second direction, and; the cap driving member is provided with a first stopper which is positioned on the arrangement surface of the first gas discharge driving member and the second gas discharge driving member and which regulates the movement of the first gas discharge driving member and the second gas discharge driving member in the second direction; the cap driving member is further movable in the first direction without changing the position of the cap after the cap arrives at the capping position; and a position of the first stopper is switched to a first regulation position at which the movement of the first gas discharge driving member is regulated, a second regulation position at which the movement of the second gas discharge driving member is regulated, and an allowance position at which the movement of both of the first gas discharge driving member and the second gas discharge driving member is not regulated, in accordance with the movement of the cap driving member in the first direction after arrival at the capping position.

According to the liquid-jetting apparatus of the present invention, the cap driving member is constructed such that the cap driving member is movable in the first direction. The first gas discharge driving member and the second gas discharge driving member, which are driven by the same driving source, are constructed such that the first gas discharge driving member and the second gas discharge driving member are arranged while being aligned in the first direction and the first gas discharge driving member and the second gas discharge driving member are movable respectively in the second direction which is parallel to the arrangement surface thereof and which intersects the first direction. Further, the cap driving member is provided with the first stopper which is positioned on the arrangement surface of the first gas discharge driving member and the second gas discharge driving member. In this arrangement, the cap driving member is moved in the first direction, and the cap arrives at the capping position. After that, the cap driving member is further moved in the first direction, and the position of the first stopper is changed. Therefore, the position of the first stopper can be selectively switched to the first regulation position and the second regulation position while allowing the cap to be brought in tight contact with the liquid-jetting surface. The first stopper regulates the movement in the second direction of any one gas discharge driving member of the first gas discharge driving member and the second gas discharge driving member. However, the first stopper does not regulate the movement of the other gas discharge driving member. Therefore, it is possible to selectively open/close the first gas discharge valve and the second gas discharge valve. When the position of the first stopper is switched to the allowance position, the first stopper does not regulate the movement of both of the first gas discharge driving member and the second gas discharge driving member. Therefore, it is possible to open/close the first gas discharge valve and the second gas discharge valve in cooperation with each other. In this way, the movement of any one of the first gas discharge driving member and the second gas discharge driving member is regulated in the arrangement in which the first gas discharge driving member and the second gas discharge driving member are moved by means of one driving source. Accordingly, it is possible to selectively open/close the first gas discharge valve and the second gas discharge valve while allowing the cap to be positioned at the capping position. Further, it is possible to small-size or miniaturize the apparatus while reducing the cost as compared with a case in which the first gas discharge driving member and the second gas discharge driving member are moved by means of two different driving sources respectively to selectively open/close the first gas discharge valve and the second gas discharge valve.

BRIEF DESCRIPTION OF THE DRAWINGS

FIG. 5 illustrates the approaching/separating operation of a suction cap, wherein

FIG. 6 illustrates the upward/downward movement operation of an opening/closing member, wherein

FIG. 7 illustrates the movement of sliders in accordance with the rotation of a rotary cam, wherein

DESCRIPTION OF THE PREFERRED EMBODIMENTS

Next, an embodiment of the present invention will be explained. In this embodiment, the present invention is applied to a printer which records (prints), for example, desired letters and/or images on the recording paper by jetting inks from an ink-jet head to the recording paper.

Figure 1:
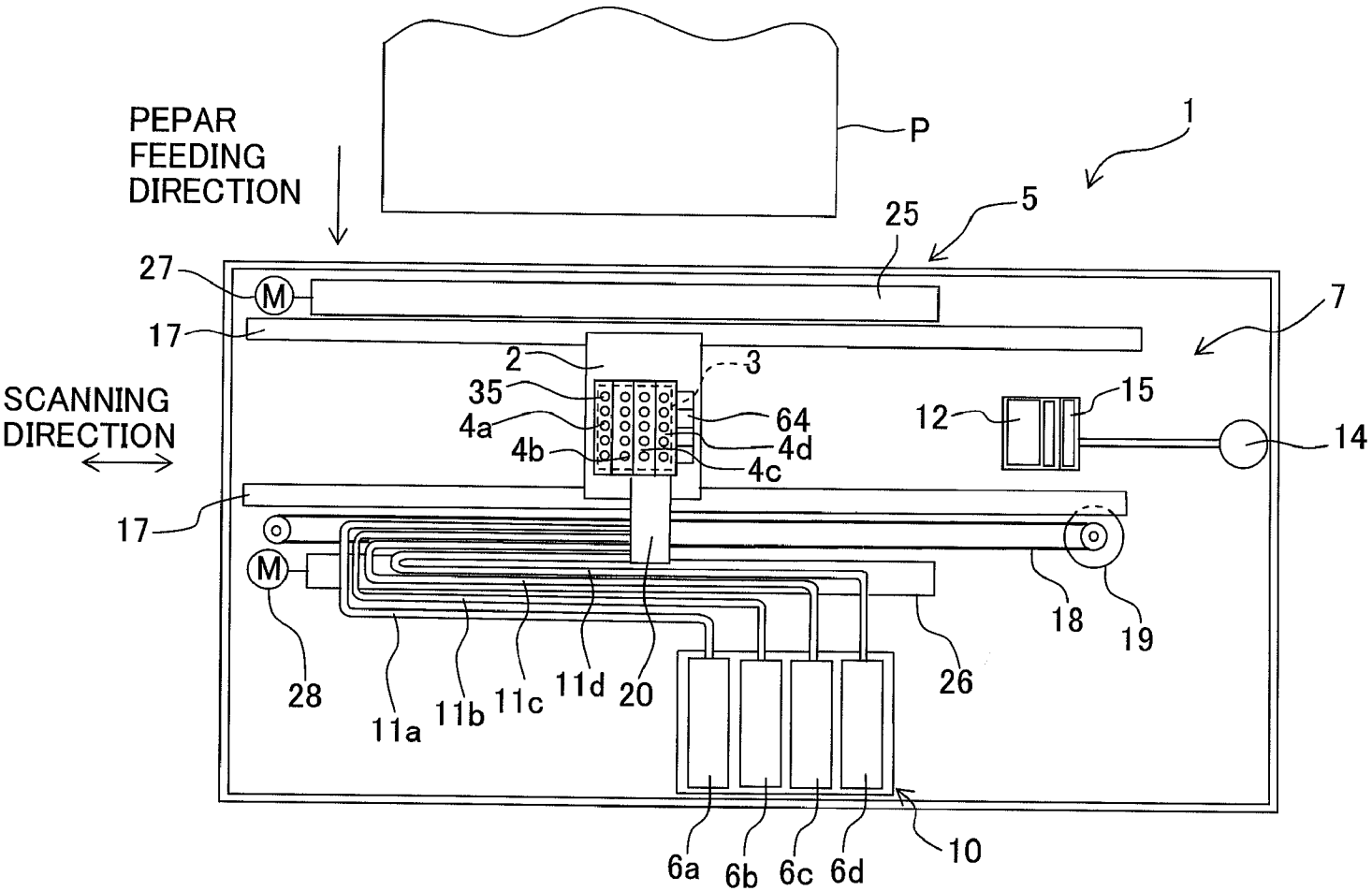
FIG. 1 shows a plan view illustrating a schematic arrangement of a printer according to an embodiment of the present invention.

As shown in FIG. 1, the printer 1 (liquid-jetting apparatus) includes, for example, a carriage 2 which is constructed reciprocatively movably in one direction, an ink-jet head 3 (liquid-jetting head) and subtanks 4*a* to 4*d* which are carried on the carriage 2, a transport mechanism 5 which transports the recording paper P in the paper feeding direction shown in FIG. 1, ink cartridges 6*a* to 6*d* which store the inks, and a maintenance unit 7 which restores the performance when the liquid-jetting performance of the ink-jet head 3 is lowered.

The carriage 2 is constructed reciprocatively movably along two guide shafts 17 which extend in parallel in the left-right direction (scanning direction) shown in FIG. 1. An endless belt 18 is connected to the carriage 2. When the endless belt 18 is driven to travel by means of a carriage driving motor 19, the carriage 2 is moved in the left-right direction in accordance with the travel of the endless belt 18.

The ink-jet head 3 and the four subtanks 4*a* to 4*d* are carried on the carriage 2. The ink-jet head 3 is reciprocatively moved in the scanning direction together with the carriage 2, while the ink-jet head 3 jets the inks from nozzles 35 which are provided on the lower surface thereof (surface disposed on the back side in relation to the paper surface shown in FIG. 1) toward the recording paper P which is transported to the lower side as viewed in FIG. 1 (in the paper feeding direction) by the transport mechanism 5. Accordingly, for example, the desired letters and/or images are recorded on the recording paper P.

The four subtanks 4*a* to 4*d* are arranged while being aligned in the scanning direction. Tube joints 20 are integrally provided for the four subtanks 4. The four subtanks 4*a* to 4*d* are connected to the four ink cartridges 6*a* to 6*d* respectively via flexible tubes 11*a* to 11*d* connected to the tube joints 20. Four gas discharge units 64 are provided at first end portions (right end portions as viewed in FIG. 1) of the four subtanks 4*a* to 4*d* in relation to the scanning direction in order to discharge the air in the subtanks 4. Details of the gas discharge units 64 will be explained later on.

The transport mechanism 5 has a paper feed roller 25 which is arranged on the upstream side in the paper feeding direction as compared with the ink-jet head 3, and a paper discharge roller 26 which is arranged on the downstream side in the paper feeding direction as compared with the ink-jet head 3. The paper feed roller 25 and the paper discharge roller 26 are driven and rotated by a paper feed motor 27 and a paper discharge motor 28 respectively. The transport mechanism 5 is constructed such that the recording paper P is supplied from the upper position as viewed in FIG. 1 to the ink-jet head 3 by means of the paper feed roller 25, and the recording paper P, on which the letters, the images and the like have been recorded by the ink-jet head 3, is discharged to the lower position as viewed in FIG. 1 by means of the paper discharge roller 26.

The four color inks of magenta, cyan, yellow, and black are stored respectively in the four ink cartridges 6*a* to 6*d*. The ink cartridges 6*a* to 6*d* are removably installed to a holder 10. The four color inks, which are stored in the four ink cartridges 6*a* to 6*d*, are temporarily stored in the subtanks 4*a* to 4*d*, and then the four color inks are supplied to the ink-jet head 3. In other words, ink supply flow passages, through which the inks are supplied to the ink-jet head 3, are constructed by the four subtanks 4*a* to 4*d* and the tubes 11*a* to 11*d* which connect the four subtanks 4*a* to 4*d* and the four ink cartridges 6*a* to 6*d* to one another. Therefore, the three subtanks 4*a* to 4*c* and the tubes 11*a* to 11*c* for supplying the color inks (magenta, cyan, and yellow), which are included in the four subtanks 4*a* to 4*d* and the tubes 11*a* to 11*d* according to this embodiment, correspond to the first liquid supply member according to the present invention, and the subtank 4*d* and the tube 11*d* for supplying the black ink correspond to the second liquid supply member according to the present invention.

Next, the subtanks 4 and the gas discharge units 64 will be explained. The structures of the four subtanks 4*a* to 4*d* for storing the four color inks respectively are basically identical with each other. Therefore, one subtank 4 of them will be explained below. The subtank 4, the gas discharge unit 64, and the maintenance unit 7 shown in FIG. 2 are depicted in the sectional views in relation to the vertical plane perpendicular to the scanning direction respectively.

Figure 2A:
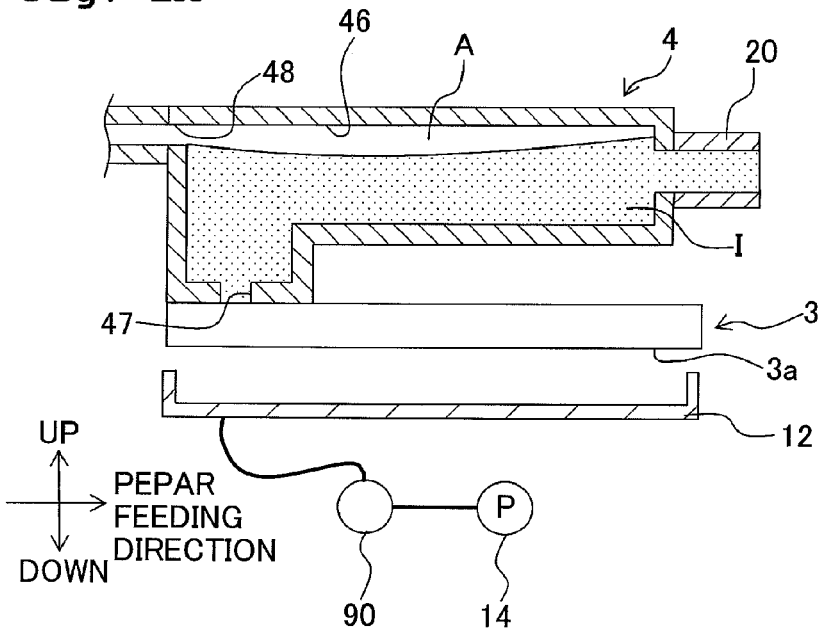
FIG. 2A shows a sectional view in relation to the vertical plane illustrating a subtank and a maintenance unit provided when a carriage is positioned at the maintenance position.
Figure 2B:
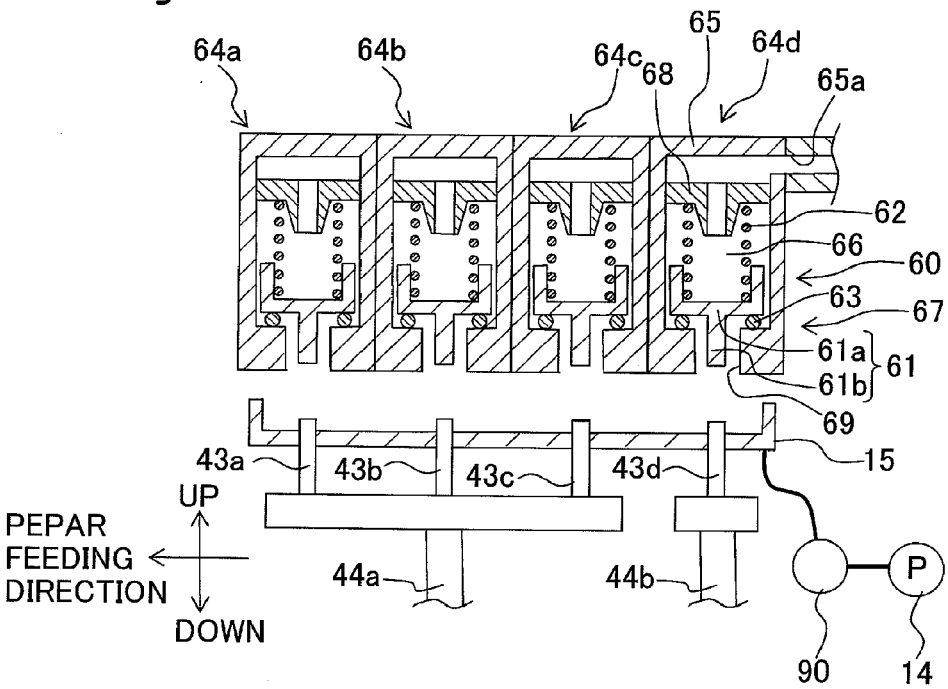
FIG. 2B shows a sectional view in relation to the vertical plane illustrating a gas discharge unit and the maintenance unit provided when the carriage is positioned at the maintenance position.

As shown in FIGS. 2A and 2B, an ink storage chamber 46 is provided in the subtank 4. The ink storage chamber 46 is communicated with the ink cartridge 6 (see FIG. 1) via the flexible tube 11 composed of, for example, a synthetic resin material connected to the tube joint 20. An ink supply hole 47 is formed at a bottom portion of the subtank 4. The ink (indicated by a symbol I shown in FIG. 2A), which is supplied from the ink cartridge 6 via the tube 11 (see FIG. 1) to the subtank 4, is temporarily stored in the ink storage chamber 46, and then the ink is supplied from the ink supply hole 47 to the ink-jet head 3.

When the air is mixed into the ink supply flow passage composed of the subtank 4 and the tube 11, a greater part of the air (indicated by a symbol A shown in FIG. 2A) stays at an upper portion of the ink storage chamber 46. The gas discharge unit 64, which discharges the air in the ink storage chamber 46 in cooperation with the maintenance unit 7, is provided at the right end portion of the subtank 4 in the scanning direction. The upper portion of the ink storage chamber 46 is communicated with a gas discharge flow passage 66 disposed in the gas discharge unit 64 via a through-hole 48 which is provided at the upper end portion of the side wall of the subtank 4.

The gas discharge unit 64 is provided for each of the four subtanks 4*a* to 4*d* for storing the four color inks (magenta, cyan, yellow, and black). The structures of the four gas discharge units 64*a* to 64*d* corresponding to the four subtanks 4*a* to 4*d* respectively are basically identical with each other. Therefore, one gas discharge unit 64 of them will be explained below. The gas discharge unit 64 includes a case 65 which is fixed to the side surface of the subtank 4, a gas discharge flow passage 66 which extends in the upward-downward direction in the case 65 and which is communicated with the ink storage chamber 46 at the upper end thereof, and a normally closed opening/closing valve 60 which opens/closes the gas discharge flow passage 66.

A through-hole 65*a* is formed at an upper end portion of the side wall of the case 65. The upper end of the gas discharge flow passage 66 in the case 65 is communicated with the upper portion of the ink storage chamber 46 for constructing the ink supply flow passage to the ink-jet head 3, via the through-hole 65*a* and the through-hole 48 of the subtank 4. The gas discharge flow passage 66 extends from the upper end connected to the ink storage chamber 46 to a gas discharge port 69 which is formed at the lower end of the case 65.

The opening/closing valve 60 includes a valve member 61 which is arranged movably in the upward-downward direction in the gas discharge flow passage 66 and which is capable of closing the gas discharge flow passage 66, and a coil spring 62 which urges the valve member 61 downwardly (in the direction to close the gas discharge flow passage 66). The valve member 61 has a valve plug 61*a* which has a bottom-equipped cylindrical shape and which is movable in the upward-downward direction in the gas discharge flow passage 66, and a valve rod 61*b* which extends downwardly from the bottom portion of the valve plug 61*a*. The outer diameter of the valve plug 61*a* is smaller than the inner diameter of the gas discharge flow passage 66. The ink can flow through the space between the valve plug 61*a* and the inner wall surface of the gas discharge flow passage 66. An annular seal member 63 is installed to the lower surface of the valve plug 61*a*. The valve plug 61*a* is constructed such that the valve plug 61*a* abuts against a valve seat surface 67 provided at an intermediate step portion of the gas discharge flow passage 66 by the aid of the seal member 63, and thus the gas discharge flow passage 66 is closed thereby.

A spring receiving section 68 is fixedly provided at the inside of the upper end portion of the case 65. The upper space and the lower space of the spring receiving section 68 are communicated with each other via a through-hole. The coil spring 62 is arranged in a compressed state between the spring receiving section 68 and the valve plug 61*a* of the valve member 61. The valve member 61 is urged downwardly (in the direction to close the gas discharge flow passage 66) by means of the coil spring 62. When the valve plug 61*a* is driven upwardly against the urging force of the coil spring 62 by means of a pin 43 of the maintenance unit 7 as described later on, then the valve plug 61*a* is separated from the valve seat surface 67, and the gas discharge flow passage 66 is opened.

The ink-jet head 3 jets, from the plurality of nozzles 35, the inks supplied into the ink flow passages of the flow passage unit via the ink supply holes 47 of the subtanks 4, by means of a piezoelectric actuator. The plurality of nozzles 35 form the nozzle arrays by arranging and aligning the plurality of nozzles 35 in the paper feeding direction, and the nozzle arrays are arranged in four arrays in the scanning direction. The lower surface of the ink-jet head 3 is an ink-jetting surface 3*a* (liquid-jetting surface) on which the plurality of nozzles 35 are open respectively. The inks of magenta, cyan, yellow, and black are jetted from the respective nozzle arrays.

Next, the maintenance unit 7 will be explained. The maintenance unit 7 performs the suction purge in which the ink is forcibly discharged from the nozzles 35 of the ink-jet head 3 and the gas discharge purge in which the air staying at the upper portion of the ink storage chamber 46 of the subtank 4 is discharged by the aid of the gas discharge unit 64. The maintenance unit 7 is arranged in an area (maintenance position) disposed at the outside (on the right side as viewed in FIG. 1) of the printing area opposed to the recording paper P within the range of movement of the carriage 2 in relation to the scanning direction. Details of the suction purge and the gas discharge purge will be described later on.

Figure 8A:
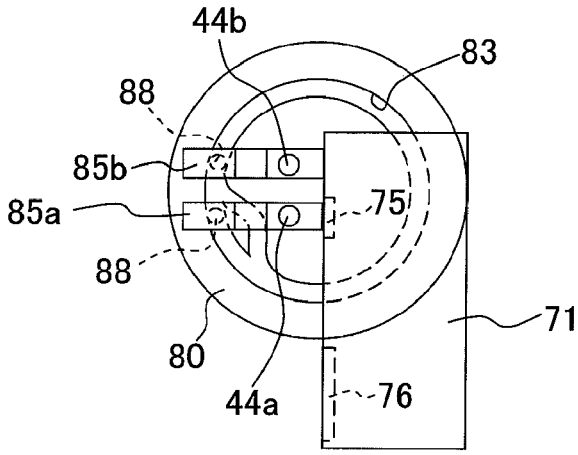
FIGS. 8A to 8C show schematic plan views illustrating the regulating operation for the sliders by stoppers.

As shown in FIGS. 1 to 4, the maintenance unit 7 includes, for example, a suction cap 12 which is capable of being brought in tight contact with the ink-jetting surface 3*a* of the ink-jet head 3, a gas discharge cap 15 which is arranged adjacently to the suction cap 12 in the scanning direction and which is capable of being brought in tight contact with the lower surfaces of the four gas discharge units 64, a suction pump 14 which is capable of being selectively connected to the suction cap 12 and the gas discharge cap 15, a cap driving mechanism 50 which upwardly/downwardly drives the suction cap 12 and the gas discharge cap 15, a valve driving mechanism 30 which drives and opens/closes the opening/closing valves 60 of the gas discharge units 64, and a switching means or changeover means 90 (see FIG. 8) which switches the connection destination of the suction pump 14.

The suction cap 12 is formed of a flexible material such as rubber, synthetic resin or the like. The suction cap 12 is comparted into two. When the carriage 2 (ink-jet head 3) is moved to the maintenance position, the suction cap 12 is opposed to the ink-jetting surface 3*a* of the ink-jet head 3 on which the plurality of nozzles 35 are arranged. When the suction cap 12 is driven upwardly in this state by means of the cap driving mechanism 50 as described later on, the suction cap 12 is brought in tight contact with the ink-jetting surface 3*a* of the ink-jet head 3 to cover the jetting ports of the plurality of nozzles 35 therewith. Accordingly, two hermetically closed spaces are formed, i.e., a hermetically closed space which is formed by the suction cap 12 and the area of the ink-jetting surface 3*a* formed with the nozzles 35 for jetting the three color inks and a hermetically closed space which is formed by the suction cap 12 and the area of the ink-jetting surface 3*a* formed with the nozzles 35 for jetting the black ink.

The gas discharge cap 15 is formed of a flexible material such as rubber, synthetic resin or the like in the same manner as the suction cap 12. When the carriage 2 (ink-jet head 3) is moved to the maintenance position, the gas discharge cap 15 is opposed to the lower surfaces of the four gas discharge units 64. When the gas discharge cap 15 is driven upwardly (toward the front in relation to the paper surface as viewed in FIG. 1) in this state together with the suction cap 12 by means of the cap driving mechanism 50 as described later on, the gas discharge cap 15 is brought in tight contact with the lower surfaces of the gas discharge units 64 to cover the gas discharge ports 69 of the four gas discharge units 64 therewith at once.

Figure 3:
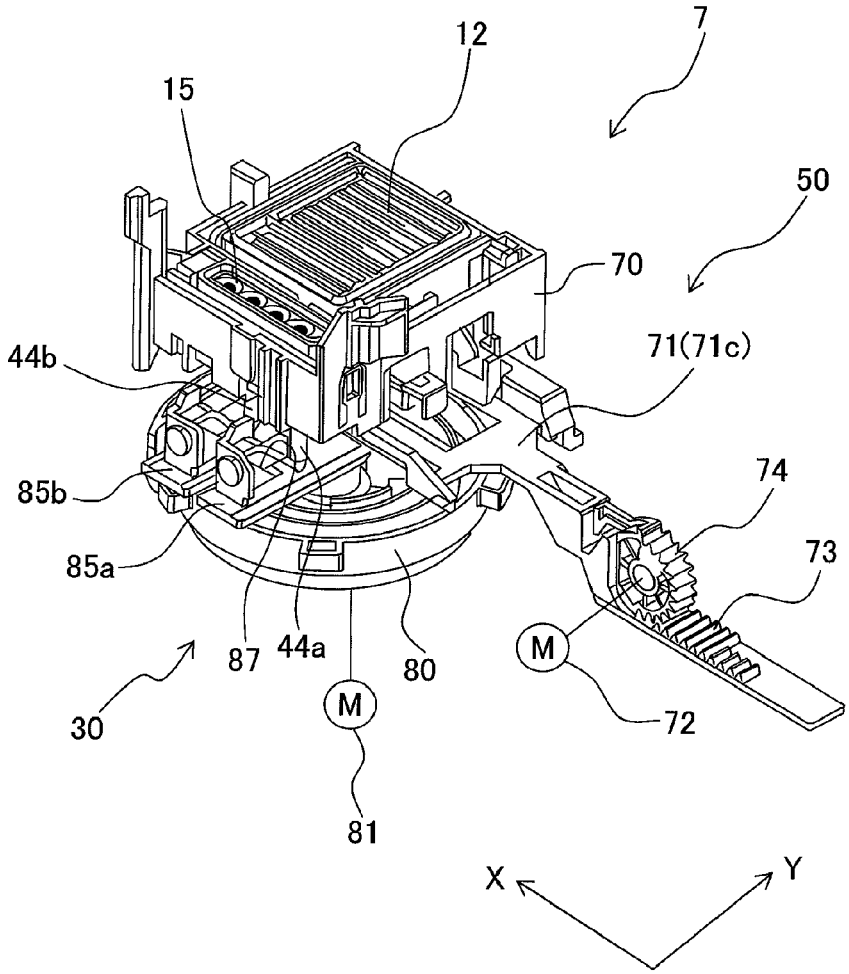
FIG. 3 shows a perspective view illustrating the maintenance unit.
Figure 4:
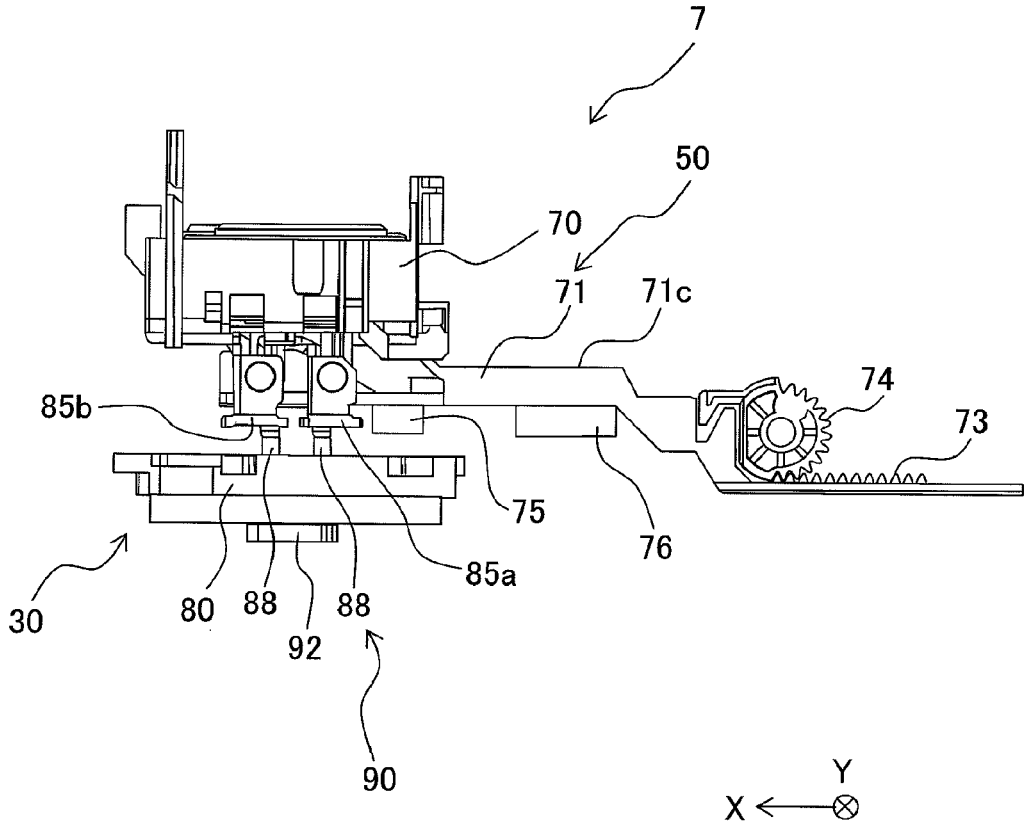
FIG. 4 shows a side view illustrating the maintenance unit.

Next, the cap driving mechanism 50 will be explained. As shown in FIGS. 3 to 5, the cap driving mechanism 50 has, for example, a cap lift holder 70 which accommodates the suction cap 12 and the gas discharge cap 15, a cap slide cam 71 (cap driving member) which is movable in the X direction (paper feeding direction: first direction) and which drives and moves the cap lift holder 70 upwardly/downwardly in accordance with the movement thereof, and a driving motor 72 which moves the cap slide cam 71 in the X direction.

The cap lift holder 70 has a substantially rectangular parallelepiped-shaped form which is open upwardly. The suction cap 12 and the gas discharge cap 15 are accommodated therein while the suction cap 12 and the gas discharge cap 15 are aligned in the Y direction (scanning direction: second direction) which is parallel to the ink-jetting surface 3*a* of the ink-jet head 3 and which is perpendicular to the X direction. The positions in the X direction and the Y direction of the cap lift holder 70 are fixed by an unillustrated support member. The cap lift holder 70 is driven and moved upwardly/downwardly in accordance with the movement of the cap slide cam 71 in the X direction.

The cap slide cam 71 is arranged under or below the cap lift holder 70. The cap slide cam 71 has a width shorter than that of the cap lift holder 70 in relation to the Y direction. The cap slide cam 71 has a horizontal surface 71*a* (first surface) which extends in the X direction, an inclined surface 71*b* (second surface) which is continued to the horizontal surface 71*a* and which is inclined downwardly while extending in the X direction, and a horizontal surface 71*c* which is continued to the inclined surface 71*b* and which extends in the X direction. The lower surface of the cap lift holder 70 is slidably brought in contact with any one surface of the horizontal surface 71*a*, the inclined surface 71*b*, and the horizontal surface 71*c* of the cap slide cam 71, and the height position thereof is determined thereby.

A rack gear 73, which extends in the X direction and which has a length longer than a total length in relation to the X direction of the horizontal surface 71*a*, the inclined surface 71*b*, and the horizontal surface 71*c*, is provided at a position which is disposed at the end portion of the cap slide cam 71 for forming the horizontal surface 71*c* and which exceeds the end portion of the cap lift holder 70. A pinion gear 74, which is connected to the driving motor 72, is meshed with the rack gear 73. When the pinion gear 74 is rotated by the driving motor 72, the cap slide cam 71 is moved in the X direction under or below the suction cap 12 in accordance with the rotation together with the rack gear 73 meshed with the pinion gear 74. Accordingly, the cap lift holder 70 slides on the horizontal surface 71*a*, the inclined surface 71*b*, and the horizontal surface 71*c* of the cap slide cam 71 in accordance with the movement of the cap slide cam 71, while the cap lift holder 70 is moved upwardly/downwardly corresponding to the height positions of the surfaces without changing the positions in the X direction and the Y direction.

A first stopper 75 and a second stopper 76, which are plate-shaped, are arranged on the lower surface of the cap slide cam 71. The first stopper 75 is arranged at the end portion disposed on the side of the inclined surface 71*b* in the lower surface area disposed on the side opposite to the horizontal surface 71*a*. The first stopper 75 has a width which is slightly shorter than ⅓ of a length of the horizontal surface 71*a* in relation to the X direction. The second stopper 76 is arranged in the lower surface area disposed on the side opposite to the horizontal surface 71*c*. The second stopper 76 has a width which is slightly longer than twice a width of the first stopper 75 in relation to the X direction.

Figure 5A:
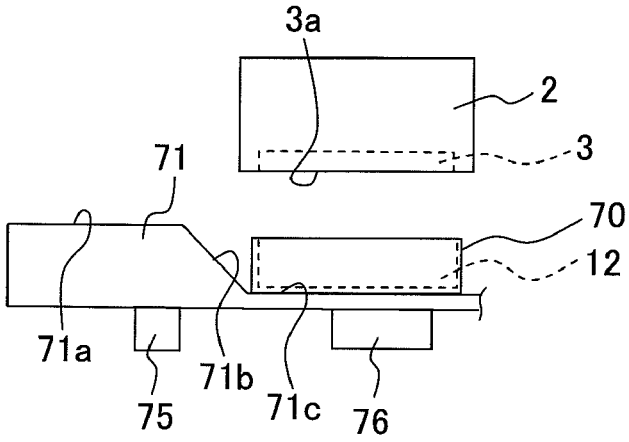
FIG. 5A shows a state in which the suction cap is positioned at the retracted position.

Next, an explanation will be made with reference to FIG. 5 about the approaching/separating operation of the suction cap 12 with respect to the ink-jetting surface 3*a* of the ink-jet head 3. As shown in FIG. 5A, the cap slide cam 71 is positioned at one end portion in the X direction (left end portion as viewed in FIG. 5A) before the suction purge is started. In this situation, the lower surface of the cap lift holder 70 is in such a state that the lower surface of the cap lift holder 70 is moved downwardly while being brought in contact with the horizontal surface 71*c* of the cap slide cam 71. The suction cap 12 is positioned at the retracted position at which the suction cap 12 is separated from the ink-jetting surface 3*a* of the ink-jet head 3.

Figure 5B:
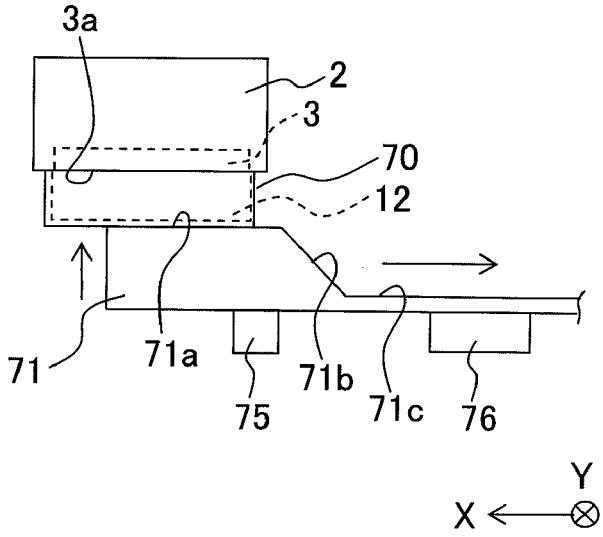
FIG. 5B shows a state in which the suction cap is positioned at the capping position.

When the cap slide cam 71 is moved in the X direction (rightward direction as viewed in FIG. 5A) by means of the driving motor 72, then the lower surface of the cap lift holder 70 slides on the horizontal surface 71*c* of the cap slide cam 71, and then the lower surface of the cap lift holder 70 is moved upwardly while sliding on the inclined surface 71*b*. Accordingly, the suction cap 12 is also moved upwardly from the retracted position in accordance with the upward movement of the cap lift holder 70. As shown in FIG. 5B, the cap slide cam 71 is further moved rightwardly, and the cap slide cam 71 is stopped when the suction cap is positioned at the capping position. Accordingly, the cap lift holder 70 is moved to the position at which the lower surface thereof is brought in contact with the horizontal surface 71*a* of the cap slide cam 71. The suction cap 12 is brought in tight contact with the ink-jetting surface 3*a* of the ink-jet head 3.

The position of the cap slide cam 71 in relation to the X direction can be detected from the number of revolutions of the driving motor 72. When the position of the cap slide cam 71 in relation to the X direction is controlled in accordance therewith, the suction cap 12 can be driven to make approach/separation between the retracted position and the capping position. The cap slide cam 71 is movable in the X direction without changing the position of the suction cap 12 during the period in which the lower surface is brought in contact with the horizontal surface 71*a* after the suction cap 12 arrives at the capping position.

When the suction cap 12 is driven to make approach/separation with respect to the ink-jetting surface 3*a* in accordance with the upward/downward movement of the cap lift holder 70, the gas discharge cap 15 is also accommodated in the cap lift holder 70 in addition to the suction cap 12. Therefore, when the suction cap 12 is moved to the capping position, and the suction cap 12 is brought in tight contact with the ink-jetting surface 3*a*, then the gas discharge cap 15 is moved upwardly in accordance therewith, and the gas discharge cap 15 is brought in tight contact with the lower surfaces of the four gas discharge units 64. When the suction cap 12 is moved to the retracted position, and the suction cap 12 is separated from the ink-jetting surface 3*a*, then the gas discharge cap 15 is moved downwardly in accordance therewith, and the gas discharge cap 15 is separated from the lower surfaces of the four gas discharge units 64.

Next, the valve driving mechanism 30 will be explained. As shown in FIGS. 3 and 4, the valve driving mechanism 30 has, for example, a first valve opening/closing member 44*a* which has three pins 43*a* to 43*c* for respectively driving and opening/closing the three opening/closing valves 60 (first gas discharge valves) for the color inks, of the four opening/closing valves 60, a second valve opening/closing member 44*b* which has a pin 43*d* for driving and opening/closing an opening/closing valve 60 (second gas discharge valve) for the remaining black ink, a first slider 85*a* (first gas discharge driving member) which is movable in the Y direction and which drives and moves the first valve opening/closing member 44*a* upwardly/downwardly in accordance with the movement thereof, a second slider 85*b* (second gas discharge driving member) which is movable in the Y direction and which drives and moves the second valve opening/closing member 44*b* upwardly/downwardly in accordance with the movement thereof, a rotary cam 80 which moves the first slider 85*a* and the second slider 85*b* in the Y direction, and a driving motor 81 (driving source) which drives and rotates the rotary cam 80.

As shown in FIG. 2, the four pins 43*a* to 43*d* are rod-shaped members extending in the upward-downward direction respectively, and they are arranged and aligned while providing spacing distances in the X direction (paper feeding direction). When the carriage 2 (ink-jet head 3) is moved to the maintenance position, the four pins 43*a* to 43*d* are positioned just under the valve rods 61*b* of the opening/closing valves 60 of the four gas discharge units 64. Further, the four pins 43*a* to 43*d* are constructed such that the four pins 43*a* to 43*d* penetrate through the bottom wall of the gas discharge cap 15 while retaining the gas tightness, and the four pins 43*a* to 43*d* are movable upwardly/downwardly with respect to the gas discharge cap 15.

The pin 43*d*, which corresponds to the gas discharge unit 64*d* for the black ink and which is included in the four pins 43*a* to 43*d*, is movable in the upward-downward direction singly. On the other hand, the three pins 43*a* to 43*c*, which correspond to the gas discharge units 64*a* to 64*d* for the three color inks respectively, are connected to one another at their end portions. The three pins 43*a* to 43*c* are integrally movable in the upward-downward direction.

As shown in FIGS. 2 to 4, the first valve opening/closing member 44*a* and the second valve opening/closing member 44*b* are arranged and aligned in the X direction. The first valve opening/closing member 44*a* connects the pins 43*a* to 43*c* for the color inks. The positions of the first valve opening/closing member 44*a* in the X direction and the Y direction are fixed by an unillustrated support member. The first valve opening/closing member 44*a* is driven and moved upwardly/downwardly in accordance with the movement of the first slider 85*a* in the Y direction. The second valve opening/closing member 44*b* is connected to the pin 43*d* for the black ink. The positions of the second valve opening/closing member 44*b* in the X direction and the Y direction are fixed by an unillustrated support member. The second valve opening/closing member 44*b* is driven and moved upwardly/downwardly in accordance with the movement of the second slider 85*b* in the Y direction.

The first slider 85*a* and the second slider 85*b* are arranged and aligned in the X direction, and they are movable in the Y direction perpendicular to the X direction which is the direction of movement of the cap slide cam 71. The first slider 85*a* and the second slider 85*b* are arranged at the same height position as that of the first stopper 75 and the second stopper 76 arranged on the lower surface of the cap slide cam 71, under or below the cap slide cam 71. When the first slider 85*a* and the second slider 85*b* are moved in the Y direction, then they are brought in contact with the first stopper 75 or the second stopper 76 depending on the position of the cap slide cam 71 in relation to the X direction, and the movement thereof is regulated. In the following description, one slider 85 of them will be explained below, because the structure of the first slider 85*a* is basically the same as that of the second slider 85*b*.

Figure 6A:
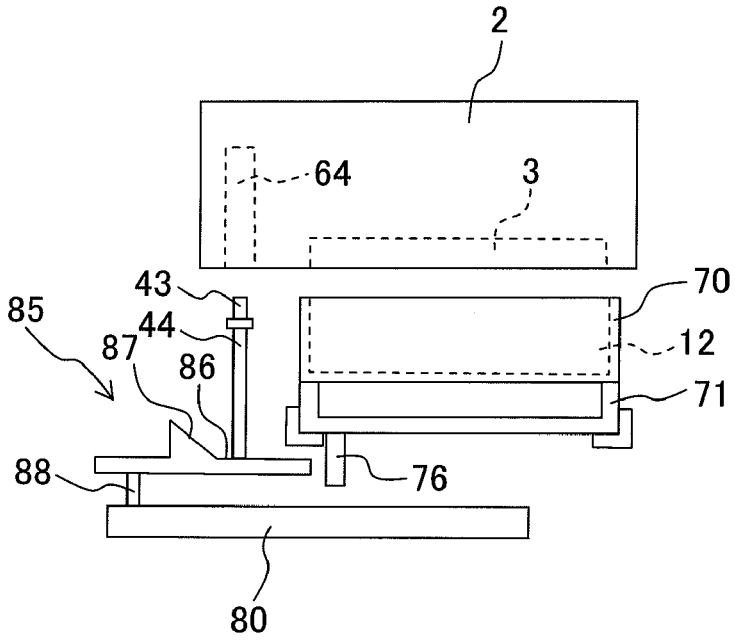
FIG. 6A shows a state in which the opening/closing member is positioned at the closed position.

As shown in FIG. 6A, a cam shaft 88, which protrudes downwardly and which is engaged with a cam groove 83 of the rotary cam 80 as described later on, is provided on the lower surface of the slider 85. Further, the slider 85 has a horizontal surface 86 which extends in the Y direction, and an inclined surface 87 which is continued to the horizontal surface 86 and which is inclined upwardly while extending in the Y direction. The lower end of the opening/closing member 44 is slidably brought in contact with any one surface of the horizontal surface 86 and the inclined surface 87 of the slider 85, and the height position thereof is determined thereby.

Figure 7A:
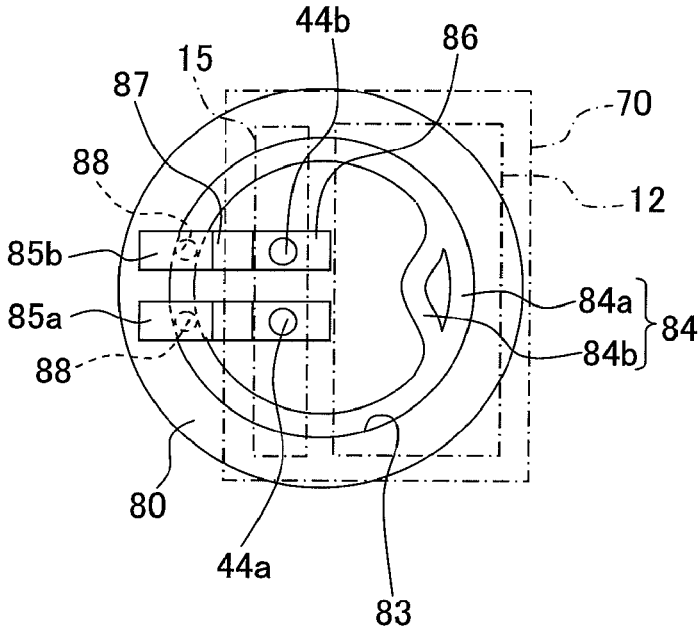
FIG. 7A shows a state in which a first slider is positioned at the waiting position.

As shown in FIG. 7A, the rotary cam 80 is arranged under or below the slider 85 so that a substantially right half is overlapped with the cap lift holder 70 as viewed in a plan view. The cam groove 83 is formed on the upper surface thereof. The position of rotation of the rotary cam 80 can be detected by counting the number of revolutions of the motor when the rotary cam 80 is rotated by the driving motor 81. The cam groove 83 is composed of a non-driving area 84*a* which is concentric with the rotary cam 80, and a driving area 84*b* which is branched from the non-driving area 84*a* and which is curved toward the center in the radial direction as compared with the non-driving area 84*a*.

The cam shafts 88 of the first slider 85*a* and the second slider 85*b* are engaged with the cam groove 83 at the positions disposed leftwardly as compared with the center of the rotary cam 80. The first slider 85*a* and the second slider 85*b* are urged toward the center of the rotary cam 80 in relation to the Y direction with respect to the rotary cam 80 by means of unillustrated springs (urging member). Therefore, when the first stopper 75*a* and the second stopper 76 of the cap slide cam 71 are not overlapped with the slider 85 in relation to the X direction, and they are positioned at the positions at which the slider 85 cannot be regulated, if the rotary cam 80 is rotated at the branch point between the non-driving area 84*a* and the driving area 84*b*, then the slider 85 is moved toward the driving area 84*b* (see, for example, the second slider 85*b* shown in FIG. 8B). When the first stopper 75 or the second stopper 76 of the cap slide cam 71 is overlapped with the slider 85 in relation to the X direction, and it is positioned at the position at which the slider 85 is regulated, if the rotary cam 80 is rotated at the branch point between the non-driving area 84*a* and the driving area 84*b*, then the slider 85 is moved toward the non-driving area 84*a*, and the slider 85 is not moved toward the driving area 84*b* (see, for example, the second slider 85*b* shown in FIG. 8A).

When the rotary cam 80 is rotated by the driving motor 81, the cam shaft 88 of the slider 85 is moved between the non-driving area 84*a* and the driving area 84*b* in accordance with the rotation. Accordingly, the slider 85 is moved in the Y direction under or below the movement range in relation to the X direction of the cap slide cam 71. Accordingly, the opening/closing member 44 slides on the horizontal surface 86 and the inclined surface 87 of the slider 85 in accordance with the movement of the slider 85, while the opening/closing member 44 is moved upwardly/downwardly corresponding to the height positions of the surfaces without changing the positions in the X direction and the Y direction.

Next, the opening/closing operation of the opening/closing valve 60 of the gas discharge unit 64 will be explained with reference to FIGS. 6 and 7. The following description will be made assuming that the first stopper 5 and the second stopper 6 of the cap slide cam 71 are positioned at the positions at which it is impossible to regulate the movement of the first slider 85*a* and the second slider 85*b*. An explanation will be made as exemplified by the first slider 85*a* by way of example.

As shown in FIGS. 6A and 7A, the rotary cam 80 is positioned at the origin position (zero point position) before the gas discharge purge is started. The cam shaft 88 of the first slider 85*a* is engaged with the non-driving area 84*a* disposed at the position separated from the driving area 84*b*. The first slider 85*a* waits at the waiting position. In this situation, the opening/closing member 44*a* is positioned on the horizontal surface 86 of the first slider 85*a*. The three pins 43*a* to 43*c*, which are connected to the opening/closing member 44*a*, are positioned at the closed positions separated from the valve rods 61*b* of the opening/closing valves 60 of the gas discharge units 64.

Figure 6B:
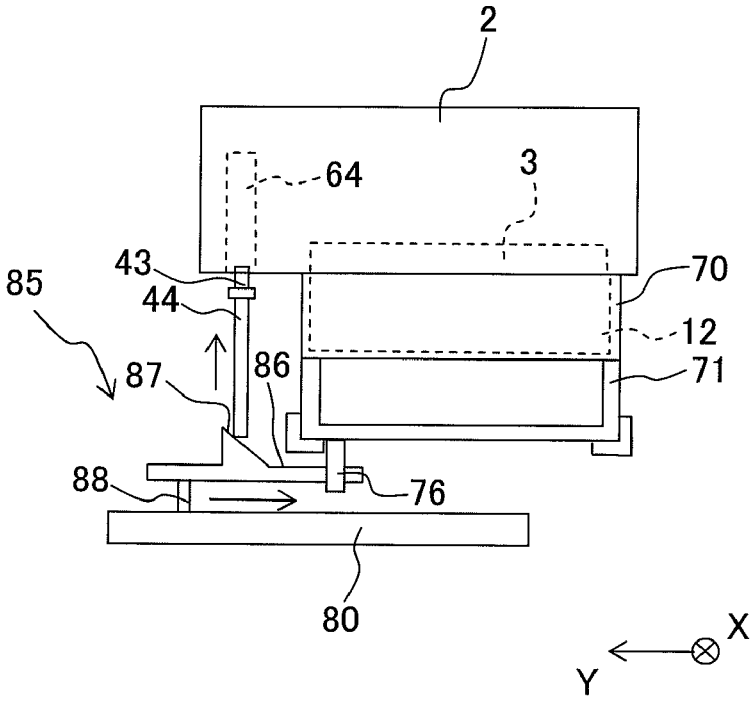
FIG. 6B shows a state in which the opening/closing member is positioned at the open position.
Figure 7B:
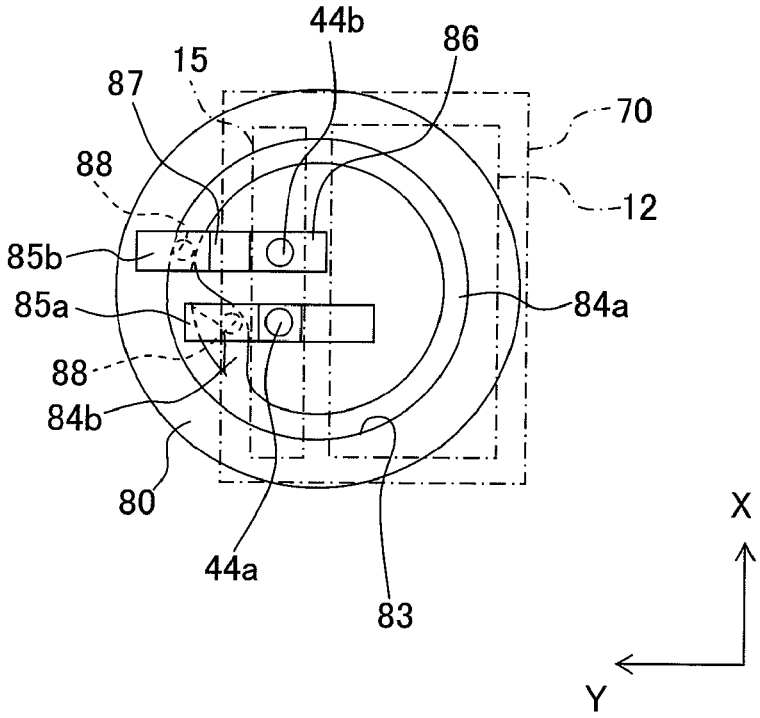
FIG. 7B shows a state in which the first slider is positioned at the open position.

When the rotary cam 80 is rotated, and the cam shaft 88 of the first slider 85*a* is moved from the non-driving area 84*a* to the driving area 84*b*, then the first slider 85*a* slides rightwardly. Accordingly, as shown in FIGS. 6B and 7B, the first slider 85*a* is moved in the Y direction from the waiting position to the open position. In this situation, the opening/closing member 44*a* is moved upwardly while sliding from the horizontal surface 86 to the inclined surface 87 of the first slider 85*a*, and the opening/closing member 44*a* is positioned at the open position. Accordingly, the upper ends of the three pins 43*a* to 43*c* (see FIG. 2) connected to the opening/closing member 44*a* are brought in contact with the lower ends of the valve rods 61*b* (see FIG. 2) of the opening/closing valves 60 of the three gas discharge units 64 for the color inks, and the valve rods 61*b* are pushed and raised. Accordingly, the valve plugs 61*a* are moved upwardly integrally with the valve rods 61*b*, the valve plugs 61*a* are separated from the valve seat surfaces 67 (see FIG. 2), and the gas discharge flow passages 66 (see FIG. 2) are opened.

Figure 9:
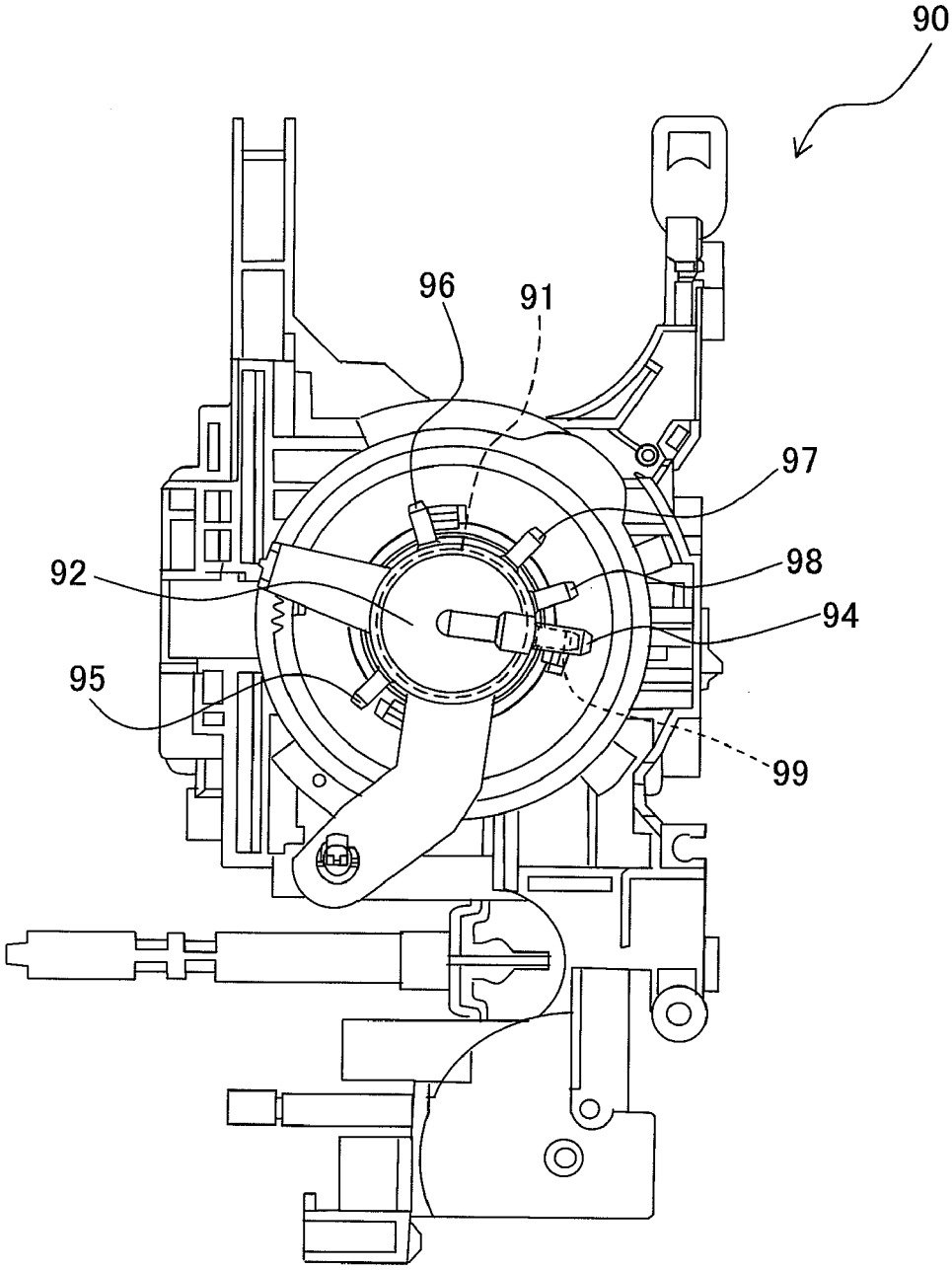
FIG. 9 shows a bottom view illustrating those shown in FIG. 3 as viewed from the bottom surface.

Next, the switching means 90 will be explained with reference to FIGS. 9 and 10. As shown in FIGS. 9 and 10, the switching means 90 has, for example, a switching member 91 which is capable of selectively switching the connection destination of the suction pump 14 to the suction cap 12 and the gas discharge cap 15 and which is arranged on the lower surface of the rotary cam 80, and a cover 92 which accommodates the switching member 91.

The switching member 91 has a disk-shaped form formed of an elastic member such as rubber or the like, and the switching member 91 is arranged at the central portion of the lower surface of the rotary cam 80. A switching flow passage 93 is formed on the outer surface thereof. The switching flow passage 93 is composed of four branch grooves 93*a* which extend in the radial direction from the center of the lower surface of the switching member 91.

The cover 92 has a bottom-equipped cylindrical shape. A gas suction port 94 is formed at the center of the bottom wall of the cover 92. The gas suction port 94 is connected to the suction pump 14 via an unillustrated tube. Five ports 95 to 99 are formed on the circular circumferential wall of the cover 92 while providing spacing distances in the circumferential direction. The first port is the gas discharge port 95 which is communicated with the interior of the gas discharge cap 15. The second port is the Bk port 96 which is communicated with the space of the suction cap 12 to which the black ink is discharged. The third port is the Co port 97 which is communicated with the space of the suction cap 12 to which the color inks are discharged. The remaining two ports are the atmospheric air ports 98, 99 which are open to the atmospheric air.

The cover 92 is relatively rotatable with respect to the rotary cam 80 and the switching member 91. When the rotary cam 80 is rotated by the first angle from the zero point position, then the switching member 91 is rotated together with the rotary cam 80 from the position shown in FIG. 10A, and the switching member 91 is rotated to arrive at the position shown in FIG. 10B. When the suction pump 14 is communicated via the Co port 97 with the space of the suction cap 12 to which the color inks are discharged, then the cam shafts 88 of the first slider 85*a* and the second slider 85*b* are engaged with the non-driving area 84*a* of the cam groove 83 as shown in FIG. 7A, and the cam shafts 88 are positioned at the waiting positions. When the rotary cam 80 is rotated by the second angle from the zero point position, the switching member 91 is also rotated together therewith to arrive at the position shown in FIG. 10C. When the suction pump 14 is communicated via the Bk port 96 with the space of the suction cap 12 to which the black ink is discharged, then the cam shafts 88 of the first slider 85*a* and the second slider 85*b* are also engaged with the non-driving area 84*a* of the cam groove 83, and the cam shafts 88 are positioned at the waiting positions.

Figure 8B:
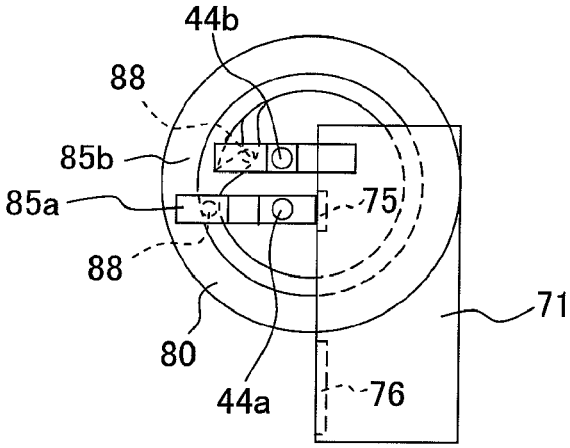
Figure 10A:
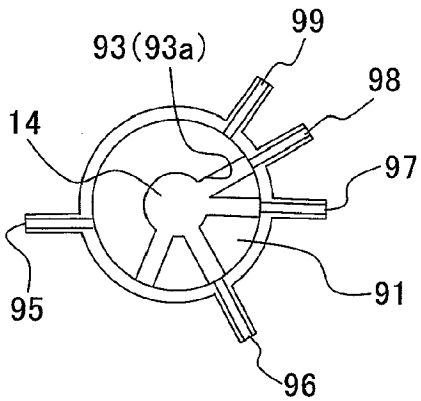
FIGS. 10A to 10E illustrate the switching or changeover of the connection destination (target) of a suction pump.
Figure 10B:
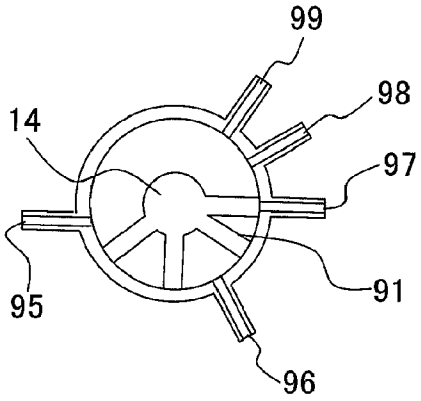
Figure 10C:
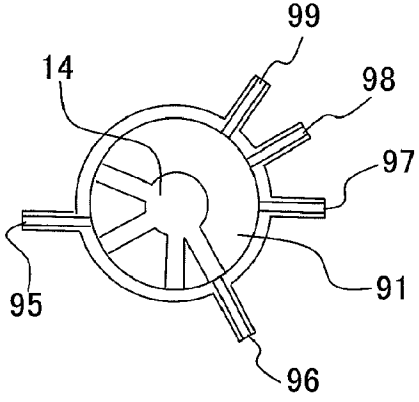
Figure 10D:
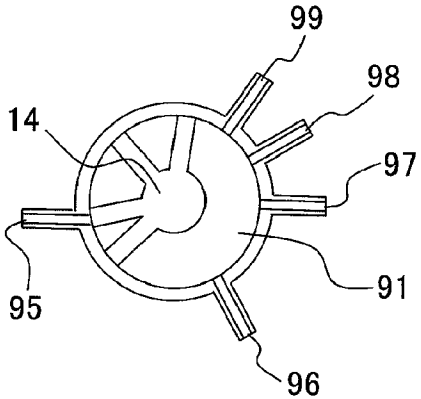
Figure 10E:
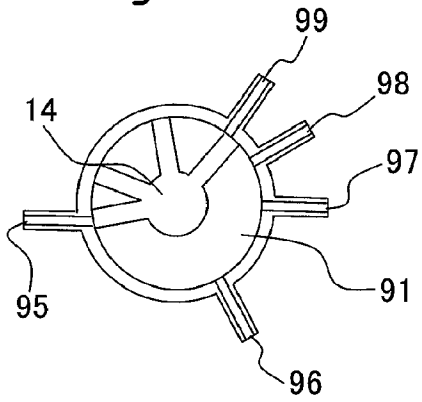

When the rotary cam 80 is rotated by the third angle from the zero point position, the switching member 91 is also rotated together therewith to arrive at the position shown in FIG. 10D. When the suction pump 14 is communicated via the gas discharge port 95 with the space in the gas discharge cap 15, then the cam shaft 88 of the first slider 85*a* is engaged with the driving area 84*b* of the cam groove 83 as shown in FIG. 7B, and the cam shaft 88 is positioned at the open position. Further, the cam shaft 88 of the second slider 85*b* is engaged with the non-driving area 84*a* of the cam groove 83, and the cam shaft 88 is positioned at the waiting position. When the rotary cam 80 is rotated by the fourth angle from the zero point position, the switching member 91 is also rotated together therewith to arrive at the position shown in FIG. 10E. When the suction pump 14 is communicated via the gas discharge port 95 with the space in the gas discharge cap 15, then the cam shaft 88 of the second slider 85*b* is engaged with the driving area 84*b* of the cam groove 83 as shown in FIG. 8B, and the cam shaft 88 is positioned at the open position. Further, the cam shaft 88 of the first slider 85*a* is engaged with the non-driving area 84*a* of the cam groove 83, and the cam shaft 88 is positioned at the waiting position. In this way, the angle of rotation of the switching member 91 is changed depending on the angle of rotation of the rotary cam 80. The communication destination of the suction pump 14 is switched, and the positions of the first slider 85*a* and the second slider 85*b* are switched as well.

Next, the suction purge will be explained. At first, the pinion gear 74 is driven by the driving motor 72 to move the cap slide cam 71 from the retracted position to the capping position in a state in which the carriage 2 is moved to the maintenance position and the ink-jetting surface 3*a* of the ink-jet head 3 is opposed to the suction cap 12. Accordingly, the suction cap 12 is brought in tight contact with the ink-jetting surface 3*a* of the ink-jet head 3 to cover the nozzles 35 therewith.

The rotary cam 80, which is disposed at the zero point position, is rotated by the first angle together with the switching member 91, and the hermetically closed space, which is formed by the suction cap 12 and the area of the ink-jetting surface 3*a* arranged with the nozzles 35 for the color inks, is communicated with the suction pump 14 by the aid of the switching member 91. When the suction operation of the suction pump 14 is performed in this state, then the air contained in the hermetically closed space is sucked, the pressure is lowered, and the inks are discharged from the nozzles 35 for the color inks to the suction cap 12. Accordingly, it is possible to discharge the viscosity-increased inks contained in the nozzles 35 for the color inks and the bubble mixed into the ink flow passages in the ink-jet head 3, together with the inks from the nozzles 35. When the suction purge is completed, then the rotary cam 80 is further rotated, and the rotary cam 80 is restored to the zero point position.

When the suction purge for the black ink is performed, then the rotary cam 80, which is disposed at the zero point position, is rotated by the second angle in a state in which the suction cap 12 is brought in tight contact with the ink-jetting surface 3*a* of the ink-jet head 3 to cover the nozzles 35 therewith, and the hermetically closed space, which is formed by the suction cap 12 and the area of the ink-jetting surface 3*a* arranged with the nozzles 35 for the black ink, is communicated with the suction pump 14 by the aid of the switching member 91. When the suction operation of the suction pump 14 is performed in this state, the ink is discharged from the nozzles 35 for the black ink to the suction cap 12. Accordingly, it is possible to discharge the viscosity-increased ink contained in the nozzles 35 for the black ink and the bubble mixed into the ink flow passage in the ink-jet head 3, together with the ink from the nozzles 35.

Next, the gas discharge purge will be explained. At first, the pinion gear 74 is driven by the driving motor 72 to move the cap slide cam 71 from the retracted position to the capping position in a state in which the carriage 2 is moved to the maintenance position and the ink-jetting surface 3*a* of the ink-jet head 3 is opposed to the suction cap 12. Accordingly, the gas discharge cap 15 is brought in tight contact with lower surfaces of the gas discharge units 64 to cover the gas discharge ports 69 of the four gas discharge units 64 at once, and the suction cap 12 is brought in tight contact with the ink-jetting surface 3*a* of the ink-jet head 3 to cover the nozzles 35 therewith.

The rotary cam 80, which is disposed at the zero point position, is rotated by the third angle, and the first slider 85*a* for the color inks is moved from the waiting position to the open position. Accordingly, the three pins 43*a* to 43*c* for the color inks are moved from the closed positions to the open positions, and thus the three gas discharge flow passages 66, which correspond to the three color inks, are opened by the three pins 43*a* to 43*c*. The switching member 91 is also rotated in accordance with the rotation of the rotary cam 80. The hermetically closed space in the gas discharge cap 15 is communicated with the suction pump 14 by the aid of the switching member 91. When the suction operation of the suction pump 14 is performed in this state, then the air, which is contained in the hermetically closed space formed by the gas discharge cap 15 and the lower surfaces of the gas discharge units 64, is sucked, and the pressure is lowered. In this situation, the air, which stays at the upper portions of the ink storage chambers 46 of the subtanks 4 corresponding to the three color inks, is discharged via the gas discharge flow passages 66. When the gas discharge purge for the color inks is completed, then the rotary cam 80 is further rotated, and the rotary cam 80 is restored to the zero point position.

When the gas discharge purge is performed for the black ink, the rotary cam 80, which is disposed at the zero point position, is rotated by the fourth angle, and the second slider 85*b* for the black ink is moved from the waiting position to the open position. Accordingly, the pin 43*d* for the black ink is moved from the closed position to the open position, and thus the gas discharge flow passage 66, which corresponds to the black ink, is opened by the pin 43*d*. The switching member 91 is also rotated in accordance with the rotation of the rotary cam 80. The hermetically closed space in the gas discharge cap 15 is communicated with the suction pump 14 by the aid of the switching member 91. When the suction operation of the suction pump 14 is performed in this state, then the air, which is contained in the hermetically closed space formed by the gas discharge cap 15 and the lower surface of the gas discharge unit 64, is sucked, and the pressure is lowered. In this situation, the air, which stays at the upper portion of the ink storage chamber 46 of the subtank 4 corresponding to the black ink, is discharged via the gas discharge flow passage 66.

As described above, when the suction purge and the gas discharge purge are performed, the rotary cam 80 is rotated from the zero point to the angle corresponding thereto. However, after the operations are completed, it is necessary that the rotary cam 80 should be rotated one turn to return the rotary cam 80 to the zero point in order to adjust the zero point.

As described above, both of the first slider 85*a* and the second slider 85*b* are successively moved as well during the period in which the rotary cam 80 is rotated one turn. Therefore, the three opening/closing valves 60 corresponding to the color inks and the opening/closing valve 60 corresponding to the black ink are successively opened/closed. In view of the above, in the embodiment of the present invention, it is possible to regulate the movement of the first slider 85*a* and the second slider 85*b* by means of the first stopper 75 arranged on the lower surface of the cap slide cam 71 in accordance with the movement in the X direction of the cap slide cam 71 without changing the position of the suction cap 12 after the suction cap 12 arrives at the capping position. Further, when the suction cap 12 is positioned at the waiting position, the movement of the first slider 85*a* and the second slider 85*b* is regulated by the second stopper 76 arranged on the lower surface of the cap slide cam 71.

Figure 11A:
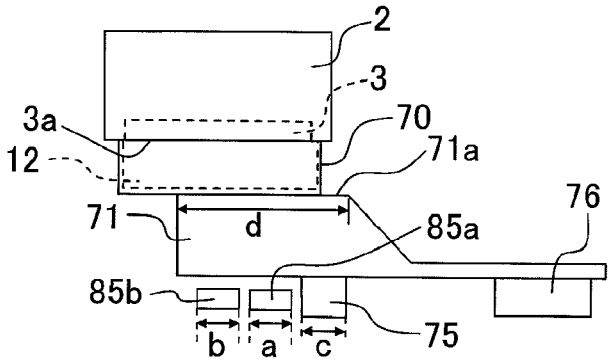
FIGS. 11A to 11D show schematic side views illustrating the regulating operation for the sliders by the stoppers.

As shown in FIG. 11A, the length d of horizontal surface 71*a* of the cap slide cam 71 in relation to the X direction is longer than the total length of the length a of the first slider 85*a* in relation to the X direction, the length b of the second slider 85*b* in relation to the X direction, and the length c of the first stopper 75 in relation to the X direction.

In this way, the horizontal surface 71*a* of the cap slide cam 71 is the surface which is parallel to the ink-jetting surface 3*a*. Accordingly, it is possible to change the position of the cap slide cam 71 in a state in which the suction cap 12 is positioned at the capping position. As shown in FIG. 11A, when the first stopper 75 of the cap slide cam 71 is positioned at the allowance position at which the first stopper 75 is not overlapped with any one of the first slider 85*a* and the second slider 85*b* in relation to the X direction, each of the first slider 85*a* and the second slider 85*b* is movable. The three opening/closing valves 60 corresponding to the color inks and the opening/closing valve 60 corresponding to the black ink can be opened/closed in cooperation with each other.

Figure 11B:
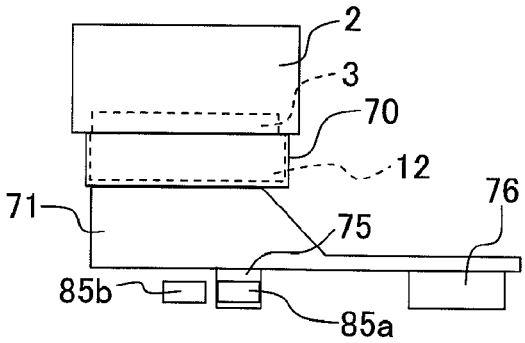
Figure 11C:
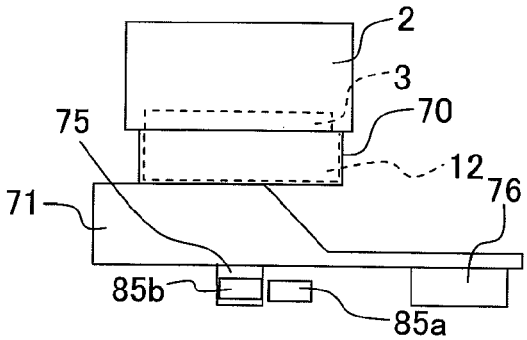

As shown in FIG. 11B, when the first stopper 75 of the cap slide cam 71 is positioned at the first regulation position at which the first stopper 75 is overlapped with the first slider 85*a* in relation to the X direction, then the movement of the first slider 85*a* is regulated, and the three opening/closing valves 60 corresponding to the color inks cannot be opened. Only the second slider 85*b* is movable, and only the opening/closing valve 60 corresponding to the black ink can be opened/closed (see FIGS. 8A and 8B). Further, as shown in FIG. 11C, when the first stopper 75 of the cap slide cam 71 is positioned at the second regulation position at which the first stopper 75 is overlapped with the second slider 85*b* in relation to the X direction, then the movement of the second slider 85*b* is regulated, and only the first slider 85*a* is movable. The opening/closing valve 60 corresponding to the black ink cannot be opened, and only the three opening/closing valves 60 corresponding to the color inks can be opened/closed.

In this way, the position of the first stopper 75 is selectively switched to the first regulation position and the second regulation position by means of the movement in the X direction of the cap slide cam 71 after the arrival at the capping position without changing the position of the suction cap 12 any more in the state in which the suction cap 12 arrives at the capping position. Accordingly, the first stopper 75 regulates the movement in the Y direction of any one slider 85 of the first slider 85*a* and the second slider 85*b*, while the other slider 85 is movable. Therefore, it is possible to selectively open/close the opening/closing valve 60 corresponding to the black ink and the three opening/closing valves 60 corresponding to the color inks.

Therefore, when the movement of any one of the first slider 85*a* and the second slider 85*b* is regulated in the arrangement in which the first slider 85*a* and the second slider 85*b* are moved by one driving motor 81 by using the rotary cam 80, it is possible to selectively open/close the opening/closing valve 60 corresponding to the black ink and the three opening/closing valves 60 corresponding to the color inks irrespective of the rotation direction of the rotary cam 80 while allowing the suction cap 12 to be positioned at the capping position. Further, it is possible to miniaturize the printer 1 while reducing the cost as compared with a case in which the first slider 85*a* and the second slider 85*b* are moved by two rotary cams 80 respectively to selectively open/close the opening/closing valve 60 corresponding to the black ink and the three opening/closing valves 60 corresponding to the color inks.

In this arrangement, the X direction, in which the cap slide cam 71 is moved, is perpendicular to the Y direction in which the first slider 85*a* and the second slider 85*b* are moved. Therefore, the first slider 85*a* and the second slider 85*b* are perpendicularly brought in contact with the surface of the first stopper 75. It is possible to reliably regulate the movement of the first slider 85*a* and the second slider 85*b* by means of the first stopper 75 while miniaturizing the printer 1.

Figure 8C:
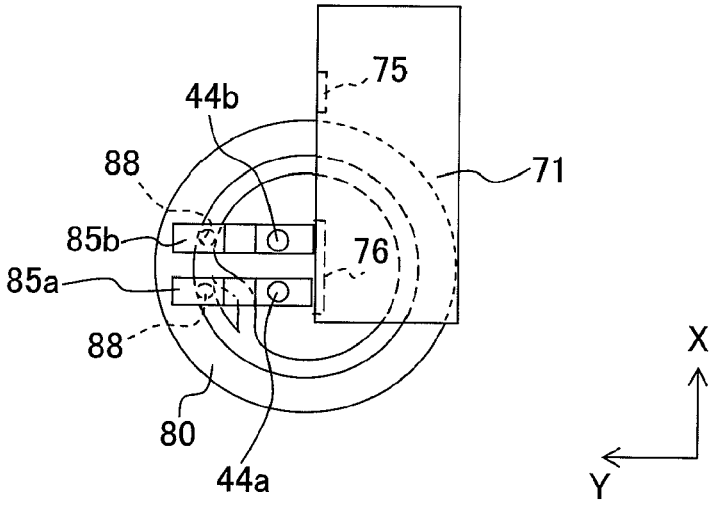
Figure 11D:
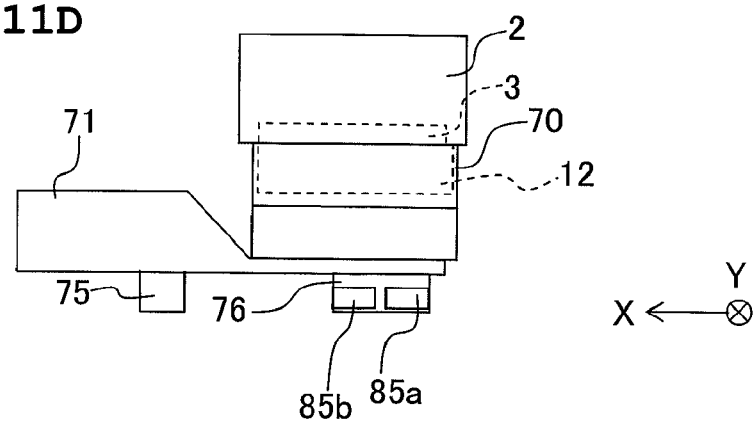

If the opening/closing valve 60 of the gas discharge unit 64 is opened in a state in which the suction cap 12 is at the retracted position and the ink-jetting surface 3*a* is not covered therewith, then the meniscus of the surfaces of the nozzles 35 is destroyed, and the air is mixed from the nozzles 35. In view of the above, in the embodiment of the present invention, as shown in FIGS. 8C and 11D, when the suction cap 12 is positioned at the retracted position, then the second stopper 76, which is arranged on the lower surface of the cap slide cam 71, is disposed at the position at which the second stopper 76 is overlapped with both of the first slider 85*a* and the second slider 85*b* in relation to the X direction, and the second stopper 76 regulates the movement of both of the first slider 85*a* and the second slider 85*b*. Accordingly, when the suction cap 12 is positioned at the retracted position, it is possible to regulate the movement of the first slider 85*a* and the second slider 85*b* by means of the second stopper 76. It is possible to reliably prevent the three opening/closing valves 60 corresponding to the color inks and the opening/closing valve 60 corresponding to the black ink from being opened in a state in which the nozzles 35 are not hermetically closed by the suction cap 12.

In this situation, the cap slide cam 71, which is provided with the second stopper 76, is supported by an unillustrated maintenance base at approximately the same height as that of the height position of the second stopper 76. Therefore, when the first slider 85*a* and the second slider 85*b* are brought in contact with the second stopper 76, the support point for supporting the cap slide cam 71 and the in-plane direction in which the cap slide cam 71 is pushed reside in the same plane. Therefore, the suction cap 12 and the gas discharge cap 15, which are arranged on the cap slide cam 71, are not inclined. It is possible to prevent the inks contained in the suction cap 12 and the gas discharge cap 15 from causing any overflow.

Next, an explanation will be made about a modified embodiment in which various changes are applied to the embodiment of the present invention. However, those constructed in the same manner as those of the embodiment described above are designated by the same reference numerals, any explanation of which will be appropriately omitted.

In the embodiment of the present invention, the X direction, in which the cap slide cam 71 is moved, is perpendicular to the Y direction in which the first slider 85*a* and the second slider 85*b* are moved. However, the direction, in which the cap slide cam 71 is moved, may merely intersect the direction in which the first slider 85*a* and the second slider 85*b* are moved, without being perpendicular thereto, provided that the first stopper 75 and the second stopper 76 of the cap slide cam 71 can be moved to the positions at which the first slider 85*a* and the second slider 85*b* can be regulated.

In the embodiment and the modified embodiment thereof explained above, the present invention is applied to the ink-jet printer for recording, for example, the image by jetting the inks onto the recording paper. However, the application objective of the present invention is not limited to those usable in the way of use as described above. That is, the present invention is applicable to various liquid-jetting apparatuses wherein various types of liquids other than the inks, in which the mixing of the gas and the viscosity increase due to the drying may arise, are jetted depending on the ways of use thereof.

What is claimed is:

1. A liquid-jetting apparatus comprising:

a liquid-jetting head which has a liquid-jetting surface provided with first nozzles and second nozzles opening thereon and which jets liquids of mutually different types from the first and second nozzles respectively;

a cap which is driven between a capping position at which the cap is brought in tight contact with the liquid-jetting surface of the liquid-jetting head and a retracted position at which the cap is separated from the liquid-jetting surface;

a cap driving member which moves in a predetermined first direction to drive the cap;

a first gas discharge valve and a second gas discharge valve which are constructed so that any bubble is discharged from a first liquid supply member connected to the liquid-jetting head for supplying the liquid to the first nozzles and a second liquid supply member connected to the liquid-jetting head for supplying the liquid to the second nozzles respectively;

a first valve opening/closing member which opens/closes the first gas discharge valve and a second valve opening/closing member which opens/closes the second gas discharge valve;

a first gas discharge driving member and a second gas discharge driving member which are arranged while being aligned in the first direction, which move in a second direction intersecting the first direction along an arrangement surface thereof to drive the first valve opening/closing member and the second valve opening/closing member respectively; and a driving source which moves both of the first gas discharge driving member and the second gas discharge driving member in the second direction, wherein: the cap driving member is provided with a first stopper which is positioned on the arrangement surface of the first gas discharge driving member and the second gas discharge driving member and which regulates the movement of the first gas discharge driving member and the second gas discharge driving member in the second direction;

the cap driving member is further movable in the first direction without changing the position of the cap after the cap arrives at the capping position; and a position of the first stopper is switched to a first regulation position at which the movement of the first gas discharge driving member is regulated, a second regulation position at which the movement of the second gas discharge driving member is regulated, and an allowance position at which the movement of both of the first gas discharge driving member and the second gas discharge driving member is not regulated, in accordance with the movement of the cap driving member in the first direction after arrival at the capping position.

2. The liquid-jetting apparatus according to claim 1, wherein the first direction, in which the cap driving member is moved, is perpendicular to the second direction in which the first gas discharge driving member and the second gas discharge driving member are moved.

3. The liquid-jetting apparatus according to claim 1, further comprising a rotary cam which is driven and rotated by the driving source, wherein the first gas discharge driving member and the second gas discharge driving member are reciprocated successively in the second direction by rotation of the rotary cam.

4. The liquid-jetting apparatus according to claim 1, wherein the cap driving member is provided with a second stopper which is positioned on the arrangement surface of the first gas discharge driving member and the second gas discharge driving member when the cap is positioned at the retracted position to regulate the movement of the first gas discharge driving member and the second gas discharge driving member.

5. The liquid-jetting apparatus according to claim 1, wherein: the first direction is a direction which is parallel to the liquid-jetting surface;

the cap driving member has a first surface which is parallel to the liquid-jetting surface and which is formed so that the cap driving member is movable in the first direction without changing the position of the cap positioned at the capping position and a second surface which is continuous to the first surface, which is formed so that the cap positioned at the capping position is moved to the retracted position, and which is inclined with respect to the liquid-jetting surface; and a length of the first surface in relation to the first direction is longer than a total of lengths of the first gas discharge driving member, the second gas discharge driving member, and the first stopper in relation to the first direction.

6. The liquid-jetting apparatus according to claim 3, wherein the rotary cam has a cam groove composed of a non-driving area which is concentric with the rotary cam and a driving area which is branched from the non-driving area and which is curved toward the center in the radial direction, the first gas discharge driving member and the second gas discharge driving member have a first cam shaft and a second cam shaft which slide along the cam groove respectively, and the first cam shaft and the second cam shaft slide in the driving area to reciprocate the first gas discharge driving member and the second gas discharge driving member in the second direction respectively.

7. The liquid-jetting apparatus according to claim 6, further comprising an urging member which urges the first gas discharge driving member and the second gas discharge driving member toward a center of the rotary cam.

* * * * *